US006068714A

United States Patent [19]

Fournier

[11] Patent Number: 6,068,714

[45] Date of Patent: May 30, 2000

[54] PROCESS FOR MAKING A HEAT RESISTANT NICKEL-BASE POLYCRYSTALLINE SUPERALLOY FORGED PART

[75] Inventor: Dominique François Fournier, Angais, France

[73] Assignee: Turbomeca, Bourdes, France

[21] Appl. No.: 09/061,570

[22] Filed: Apr. 16, 1998

Related U.S. Application Data

[63] Continuation-in-part of application No. 08/588,522, Jan. 18, 1996, abandoned.

[51] Int. Cl.[7] ..... C21F 1/10

[52] U.S. Cl. ..... 148/677; 148/556

[58] Field of Search ..... 148/556, 77

[56] References Cited

U.S. PATENT DOCUMENTS

| | | | |
|---|---|---|---|
| Re. 28,681 | 1/1976 | Baldwin | 420/448 |
| 2,570,194 | 10/1951 | Bieber et al. | 148/675 |
| 2,766,156 | 10/1956 | Betteridge . | |
| 3,145,130 | 8/1964 | Bieber et al. | 148/675 |
| 3,677,746 | 7/1972 | Lund et al. | 420/448 |
| 3,843,421 | 10/1974 | Cox et al. | 420/448 |
| 4,108,647 | 8/1978 | Shaw | 420/448 |
| 4,685,977 | 8/1987 | Chang | 148/556 |
| 5,328,659 | 7/1994 | Tillman . | |

FOREIGN PATENT DOCUMENTS

| | | |
|---|---|---|
| 421228 | 4/1991 | European Pat. Off. . |
| 421229 | 4/1991 | European Pat. Off. . |
| 2027898 | 1/1980 | United Kingdom . |
| WO9003450 | 4/1990 | WIPO . |
| WO9218659 | 10/1992 | WIPO . |
| WO9413849 | 6/1994 | WIPO . |

*Primary Examiner*—Deborah Yee
*Attorney, Agent, or Firm*—Harrison & Egbert

[57] ABSTRACT

The process for making a forged nickel-base superalloy part for use in the 700–900° C. range which includes the steps of:

a) providing a nickel-base superalloy having the following composition:

| | percentage by weight |
|---|---|
| Cr | 15.5–18 |
| Co | 14.0–15.5 |
| Mo | 2.75–3.25 |
| W | 1.00–1.50 |
| Ti | 4.75–5.25 |
| Al | 2.25–2.75 |
| Zr | 0.025–0.050 |
| B | 0.01–0.02 |
| C | 0.006–0.025 |
| Cu | ≦0.10 |
| Mn | ≦0.15 |
| Fe | ≦0.50 |
| Si | ≦0.2 |
| P | ≦0.05 |
| S | ≦0.05 |
| Ni | balance |

and eventual impurities, where the weight ration B/C is equal to or greater than 1.1;

b) forging said nickel-base superalloy to obtain an as-forged part;

c) submitting the as-forged part of step b) to a solution heat treatment at a temperature ranging from 10 to 30° C. above the γ' phase solvus temperature;

d) quenching the solution heat treated forged part resulting from step c) at a quenching rate above 100° C./minute;

e) submitting the part resulting from step d) to a first heat aging at a temperature ranging from 650° C. to 750° C. for at least 16 hours; and f) submitting the part resulting from step e) to a second heat aging at a temperature of 800 to 850° C. for at least 4 hours.

7 Claims, 1 Drawing Sheet

PROCESS FOR MAKING A HEAT RESISTANT NICKEL-BASE POLYCRYSTALLINE SUPERALLOY FORGED PART

RELATED APPLICATIONS

The present application is a continuation-in-part of U.S. patent application Ser. No. 08/588,522, filed on Jan. 18, 1996 and entitled "PROCESS FOR PRODUCING AND HEAT TREATING A HEAT RESISTANT NICKEL-BASE POLYCRYSTALLINE SUPERALLOY", now abandoned.

BACKGROUND ART

The present invention relates to an improved process for making a heat resistant nickel-base polycrystalline superalloy forged part.

The invention more particularly relates to a process for making forged component parts of a turbo machine, such as a forged single-piece gas turbine wheel.

Nickel-base superalloys are widely used for producing gas turbine parts.

The nickel-base superalloys are usually used for two different types of application in the gas turbine technology.

A first type of application concerns generally bulky parts such as turbine wheels which must exhibit good mechanical properties in the temperature range from ambiant to 700° C.

In this first type of applications, the part is generally produced by forgeing from remelt ingots and working or from densified alloy powders. The resulting parts usually have a fine grain structure. The main drawbacks of this route is the high sensitivity of the resulting part to intergranular rupture. This intergranular rupture occurs principally around 700° C. due to oxidation at the grain boundaries and phase precipitations at these grain boundaries.

A second type of application concerns relatively thin turbine parts such as turbine blades which must be operable at very high temperatures, typically ranging from 900 to 1200° C.

These second type of parts are usually produced by casting and heat treating alloys having a very high content of refractory metals. The resulting parts have a coarse grain structure and do not exhibit the required mechanical properties in use at the lower temperature of 700° C. or less.

Prior art nickel-base or nickel-chrome superalloy forged parts have been found not to have the required creep properties when used at temperatures higher than 650 to 700° C.

Forged parts have been produced from nickel-base polycrystalline superalloys and in particular have been sold under the trademark UDIMET 720.

One of these alloys has the following composition in percentage by weight:

chromium: 18%
cobalt: 14.7%
molybdenum: 3%
tungsten: 1.25%
titanium: 5%
aluminium: 2.5%
zirconium: 0.03% carbon: 0.035%
boron: 0.033%

Forged parts are typically made from this type of superalloy by remelting under a vacuum and/or under a slag, forging and heat treating.

Different heat treatments are classically used depending on the subsequent applications, but of which at least one includes heating beyond 1100° C. for a period of 2 to 4 hours.

There occurs at these temperatures a precipitation of the secondary phases and in particular of the carbides at the grain boundaries which has an adverse effect on the good mechanical behavior of the forged parts when used in a temperature range between 700 and 900° C., in particular by a deterioration in the area of the grain boundaries.

A first attempt to overcome this problem consisted in trying to modify the geometry of the grain boundaries to obtain the so-called "zig-zag" boundaries by acting on the precipitation of the phases. This technique is however harmful to the performances in the temperature range of between 700 and 800° C.

A second manner of proceeding consists in modifying the grain boundaries so as to trap the harmful carbides at low temperatures by the addition of boron.

SUMMARY OF THE INVENTION

An object of the invention is to provide a process for making nickel-base superalloy forged parts having improved mechanical behavior in the temperature range between 700 and 900° C. According to the invention, there is provided a process for making a forged nickel-base superalloy part for use in the 700–900° C. range which comprises the steps of:

a) providing a nickel-base superalloy having the following composition:

| | percentage by weight |
|---|---|
| Cr | 15.5–18 |
| Co | 14.0–15.5 |
| Mo | 2.75–3.25 |
| W | 1.00–1.50 |
| Ti | 4.75–5.25 |
| Al | 2.25–2.75 |
| Zr | 0.025–0.050 |
| B | 0.01–0.02 |
| C | 0.006–0.025 |
| Cu | ≦0.10 |
| Mn | ≦0.15 |
| Fe | ≦0.50 |
| Si | ≦0.2 |
| P | ≦0.05 |
| S | ≦0.05 |
| Ni | balance |

and eventual impurities, wherein the weight ratio B/C is equal to or greater than 1.1;

b) forging said nickel-base superalloy to obtain an as-forged part;

c) submitting the as-forged part of step b) to a solution heat treatment at a temperature ranging from 10 to 30° C. above the γ' phase solvus temperature;

d) quenching the solution heat treated forged part resulting from step c) at a quenching rate above 100° C./minute;

e) submitting the part resulting from step d) to a first heat aging at a temperature ranging from 650° C. to 750° C. for at least 16 hours; and f) submitting the part resulting from step e) to a second heat aging at a temperature of 800 to 850° C. for at least 4 hours.

BRIEF DESCRIPTION OF THE DRAWINGS

Many advantages result from these modifications to the process, as will be described hereinafter with reference to the accompanying figures in which.

DESCRIPTION OF THE PREFERRED EMBODIMENT

Figure 1A:
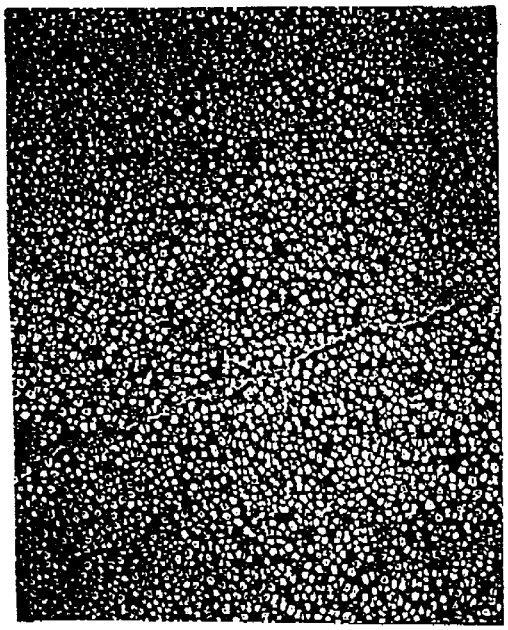
FIGS. 1A and 1B are views with a microscope respectively magnified ×2000 and ×5000 of a specimen UDIMET 720 which had been subjected to a standard treatment.

The elimination of the thermomechanical treatments at high temperature avoids the precipitation of the carbides and of the borides at the grain boundaries.

Further, the modification of the composition by reduction in the percentage of carbon limits the formation of carbides.

Preferably, the ratio B/C of the nickel-base superalloy used in the process of the invention ranges from 1.1 to 3 and more preferably from 1.1 to 2.5, it being usually about 1.5. Keeping the ratio B/C in the alloy within the required range is important to avoid a deterioration of the forged part at the grain boundaries.

The forging step is typically performed at temperatures ranging from 1100° C. to 1200° C., preferably 1100° C. to 1150° C.

The solution heat treatment is preformed at a temperature 10° C. to 30° C. higher than the γ' solvus temperature of the alloy, i.e. at a temperature of 1150° C. to 1165° C., preferably 1155° C. to 1160° C.

The quenching step is an important feature of the process according to the invention. This quenching step is a rapid quenching, at a rate higher than 100° C./minute, preferably at a rate ranging from 150 to 200° C./minute. This quenching step is usually performed in an oil bath.

Due to the combination of the above solution heat treatment and quenching steps, there is obtained in the resulting alloy an average grain size corresponding to ASTM 0–3 grain size (i.e. 100–500 μm).

As concerns the aging at low temperature, it permits increasing the volumic fraction of the phase γ' at the expense of the phase $M_{23}C_6$:

$$MC'\gamma = M_{23}C_6 + \gamma'$$

The first aging step has a duration of at least 16 hours and preferably at least 24 hours, whereas the second aging step has a duration of 4 to 16 hours, or more preferably 4 to 8 hours.

In this way, higher strength values are obtained. Indeed, under 300 MPa at 850° C., the life span up to fracture is increased from 120 to 430 hours.

The same is true of tensile strength with respect to temperature.

Forged test parts have been produced according to a conventional process and the process of the invention. Comparative results are given below.

| | STANDARD GRADE | | | NEW PROCESS | | |
|---|---|---|---|---|---|---|
| T° C. | Ultimate Tensile Strength (Mpa) | Yield Strength at 0.2% (Mpa) | Elongation (%) | Ultimate Tensile Strength (Mpa) | Yield Strength at 0.2% (Mpa) | Elongation (%) |
| 20 | 1350 | 880 | 13 | 1460 | 1000 | 15 |
| 650 | 1280 | 810 | 17 | 1380 | 920 | 11 |

Figure 1B:
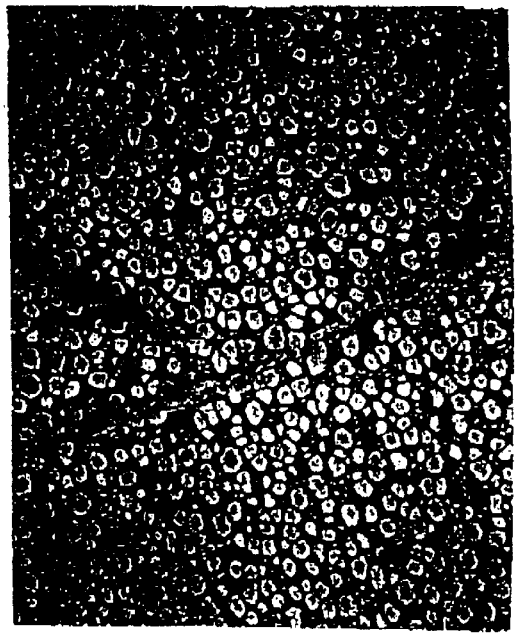

The micrographs of FIGS. 1A and 1B show the presence of phase γ' in the grain and a precipitation of γ' also at the grain boundaries but associated with precipitations of carbide and more generally of all the secondary phases.

It is also found that the grains have are relatively large size which has an adverse effect on a good strength.

Figure 2A:
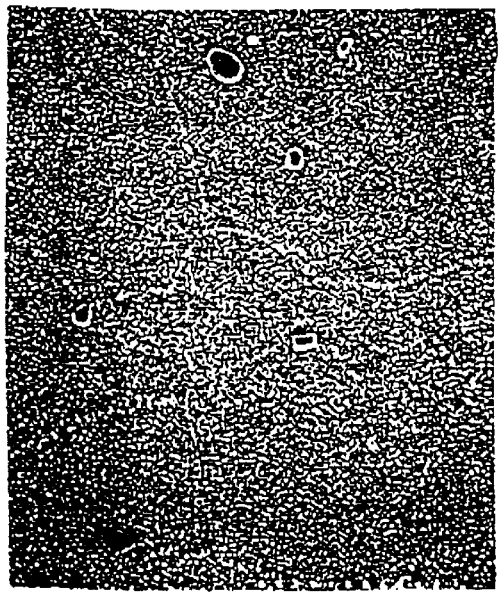
FIGS. 2A and 2B are views with the same magnifications as before of a specimen UDIMET 720 which had been produced by the process according to the invention.
Figure 2B:
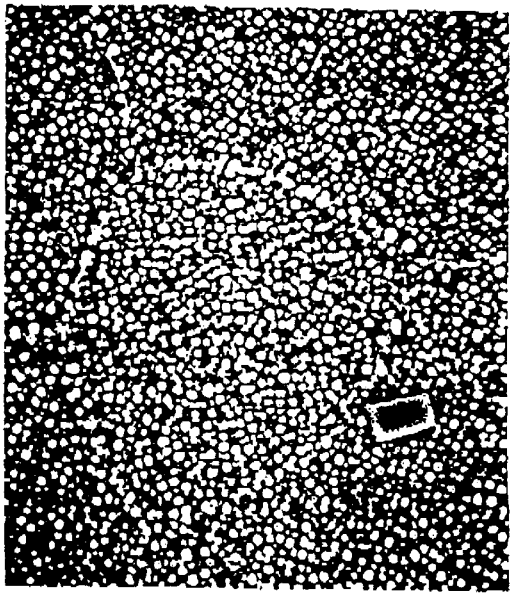

In FIGS. 2A and 2B there will first of all be noticed the fineness of the grains since the heat treatments at lower temperatures avoid grain growth.

The strength is increased and the grain boundaries are less likely to deteriorate with temperature since a smaller amount of carbides accumulates at the grain boundaries.

Contrary to general knowledge and practice in the art which proposes obtaining "slow quenching" which promotes the precipitation of large γ' and the formation of "zig-zag" grain boundaries, a rapid quenching is employed to avoid segregation at the grain boundaries.

What is claimed is:

1. A process for making a forged nickel-base superalloy part for use in the 700–900° C. range which comprises the steps of:

a) providing a nickel-base superalloy having the following composition:

| | percentage by weight |
|---|---|
| Cr | 15.5–18 |
| Co | 14.0–15.5 |
| Mo | 2.75–3.25 |
| W | 1.00–1.50 |
| Ti | 4.75–5.25 |
| Al | 2.25–2.75 |
| Zr | 0.025–0.050 |
| B | 0.01–0.02 |
| C | 0.006–0.025 |
| Cu | ≦0.10 |
| Mn | ≦0.15 |
| Fe | ≦0.50 |
| Si | ≦0.2 |
| P | ≦0.05 |
| S | ≦0.05 |
| Ni | balance |

and eventual impurities, wherein the weight ratio B/C is equal to or greater than 1.1;

b) forging said nickel-base superalloy to obtain an as-forged part;

c) submitting the as-forged part of step b) to a solution heat treatment at a temperature ranging from 10 to 30° C. above the γ' phase solvus temperature;

d) quenching the solution heat treated forged part resulting from step c) at a quenching rate above 100° C./minute;

e) submitting the part resulting from step d) to a first heat aging at a temperature ranging from 650° C. to 750° C. for at least 16 hours; and f) submitting the part resulting from step e) to a second heat aging at a temperature of 800 to 850° C. for at least 4 hours.

2. A process according to claim 1, wherein the ratio by weight ratio B/C ranges from 1.1 to 3.

3. The process according to claim 1, wherein the quenching rate of step (d) ranges from 150 to 200° C./minute.

4. The process according to claim 1, wherein the first aging step (e) has a duration of at least 24 hours.

5. The process according to claim 1, wherein the forged part is a turbine part.

6. The process according to claim 5, wherein the turbine part is a radial turbine wheel.

7. The process according to claim 1, wherein the forged part has an ASTM 0–3 grain size.

* * * * *